United States Patent [19]

Ebert et al.

[11] 4,448,612

[45] May 15, 1984

[54] METHOD OF BLACKENING SURFACES OF STEEL PARTS WITH WET NITROGEN

[75] Inventors: Chris W. Ebert, Lancaster; Earle S. Thall, Leola, both of Pa.

[73] Assignee: RCA Corporation, New York, N.Y.

[21] Appl. No.: 491,251

[22] Filed: May 3, 1983

Related U.S. Application Data

[63] Continuation-in-part of Ser. No. 351,281, Feb. 22, 1982, abandoned.

[30] Foreign Application Priority Data

Feb. 14, 1983 [FR] France ..... 83 02292

[51] Int. Cl.[3] ..... C23C 11/10

[52] U.S. Cl. ..... 148/6.35

[58] Field of Search ..... 148/6.35

[56] References Cited

U.S. PATENT DOCUMENTS

| | | | |
|---|---|---|---|
| 2,398,012 | 4/1946 | Kiser | 250/27.5 |
| 3,510,366 | 5/1970 | Mears | 148/6.35 |
| 4,035,200 | 7/1977 | Valentijn | 148/6.35 |
| 4,141,759 | 2/1979 | Pfistermeister et al. | 148/6.35 |

*Primary Examiner*—Sam Silverberg

*Attorney, Agent, or Firm*—E. M. Whitacre; D. H. Irlbeck; L. Greenspan

[57] ABSTRACT

A gaseous mixture of nitrogen and water vapor (dew point of about −8° to 32° C.), heated to 550° to 750° C., contacts the surfaces of a steel part for a sufficient time to produce adherent, deep-black layers on the part. Steel aperture masks and support frames for color television picture tubes may be blackened by the novel method.

13 Claims, 3 Drawing Figures

METHOD OF BLACKENING SURFACES OF STEEL PARTS WITH WET NITROGEN

CROSS-REFERENCE TO RELATED APPLICATION

This is a continuation-in-part of U.S. Pat. application Ser. No. 351,281 filed Feb. 22, 1982 now abandoned.

BACKGROUND OF THE INVENTION

This invention relates to a novel method of blackening surfaces of steel parts, such as aperture masks and support frames that are used in color television picture tubes. The method employs a wet nitrogen processing atmosphere which is not injurious, obnoxious or flammable, and produces deep black layers which are both adherent to, and protective of, the steel parts.

The surfaces of low-carbon steel parts, such as the aperture masks and support frames that are used in color television picture tubes, are blackened for one or more reasons. Among these reasons are: to provide resistance to rusting, to increase infrared emissivity and to increase absorption of visible light.

For uses in television picture tubes, the surfaces of the parts should be a deep black, not blue or brown or gray, in order to realize optimum spectral-light absorption and high infrared emissivity. The blackening should not flake off or crumble when the part is flexed or when it is thermally cycled. The blackening should be chemically stable in air up to about 475° C. and should provide chemical protection for the part in humid atmospheres. The blackening should be produced without distorting the part and without increasing the magnetic coercivity of the part, all at relatively low cost per part.

Although prior methods of blackening are effective, there is always a need to reduce the unit cost, to reduce hazards to health in the factory and to improve the quality of the product. Prior methods include steam blackening, exothermic blackening and dry-nitrogen blackening.

In steam blackening, the parts are heated to about 450° to 520° C. in a protective atmosphere, and then are exposed to superheated steam. This method is practiced in batch furnaces and is not economically practiced in continuously-operating furnaces. The method produces an adherent coating which has a distinct bluish cast.

In exothermic blackening, the parts are heated to about 550° to 650° C. and then exposed to an atmosphere of burnt fuel gas, which is essentially a gaseous mixture of CO, $CO_2$, $H_2$, $H_2O$, $N_2$ and $O_2$. The atmosphere may be flammable and, if uncontrolled, may be both injurious and obnoxious to factory personnel. The method requires many precise process controls to maintain suitable conditions for blackening.

In dry-nitrogen blackening, the parts are heated to about 650° C. in a protective atmosphere, and then exposed to a dry-nitrogen atmosphere. Dry nitrogen ordinarily has a dew point of less than −30° C. The atmosphere used in this method is safe and odorless, and the required process controls are relatively simple. However, the method produces a dull, soft-gray-appearing coating which has less than desirable physical properties.

SUMMARY OF THE INVENTION

The novel method for blackening surfaces of a steel part comprises producing a gaseous mixture consisting essentially of nitrogen and water vapor, the mixture having a dew point of about −8° to 32° C. This mixture, which is referred to herein as wet nitrogen, is heated to about 550° to 750° C. Then, the steel part is heated and exposed to an atmosphere of this heated mixture for a sufficient time; e.g., about 2 to 15 minutes, to produce deep-black adherent layers of iron oxide on the surfaces of the parts. The adherent layers provide the desired chemical protection, high infrared emissivity and high absorption of spectral radiation mentioned above.

The novel method employs low-cost gases which are not flammable, obnoxious or injurious. The method can be practiced in both batch and continuously-operating furnaces and requires fewer and easier controls than the prior exothermic method. As a consequence, the novel method can blacken steel parts at low cost relative to prior methods with all of the above-mentioned desirable characteristics.

DETAILED DESCRIPTION OF THE PREFERRED EMBODIMENT

Figure 1:
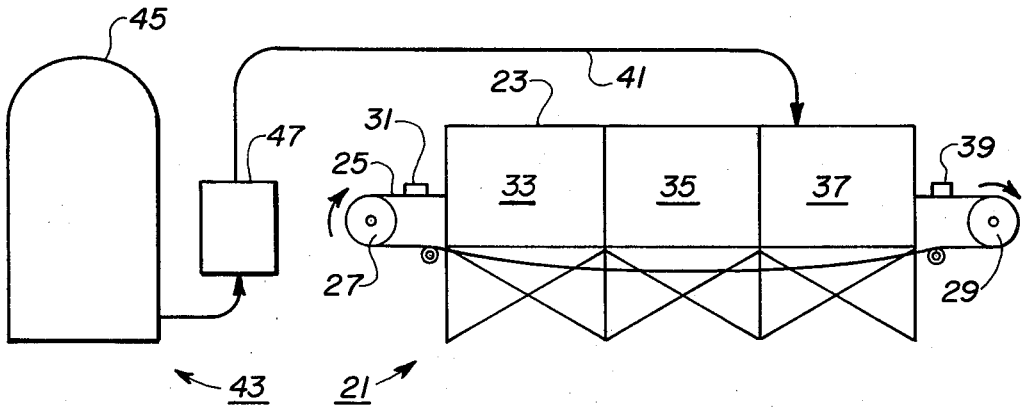
FIG. 1 is a partially-schematic, partially-elevational view of an apparatus for practicing the novel method.

The novel method is preferably carried out in the continuously-operating furnace 21 shown in FIG. 1. The furnace 21 comprises a three-section heated chamber 23 having an internal volume of about 1.7 cubic meters (about 60 cubic feet) and having controlled atmospheres therein. A stainless-steel belt 25 is supported on an idler pulley 27 and a drive pulley 29, which pulleys are located outside the chamber 23. The belt 25 passes over the idler pulley 27, through the chamber 23 through openings at each end thereof and then over the drive pulley 29. The belt 25 returns under and outside the chamber 23 to the idler pulley 27. Steel parts 31 to be blackened are placed on the belt 25 near the idler pulley 27, and pass through the chamber 23, which includes in sequence a heating section 33, a reaction section 35 and a cooling section 37. The blackened parts 39 emerge from the cooling section 37 near the drive pulley 29, where the blackened parts 39 are removed.

A gaseous mixture consisting essentially of nitrogen and water vapor is introduced into the cooling section 37 of the chamber 23 through a conduit 41, where it is heated to about 620°±10° C. The heated mixture circulates through the reaction section 35 and the heating section 33 and escapes through the curtained entrance of the heating section 33. A portion of the mixture also flows towards, and escapes through, the curtained exit of the cooling section 37.

The mixture is supplied to the conduit 41 from a wet-nitrogen generator 43, which includes a source of nitrogen gas 45. The source 45 may be any of the known systems for producing wet- or dry-nitrogen gas, but is preferably a tank of compressed dry nitrogen. From whatever the source, the nitrogen gas is passed to a bubbler 47 in which the nitrogen is bubbled through water at the desired temperature at a rate to impart the desired content of water vapor (dew point of 22±2° C. in this example) to the nitrogen. The nitrogen gas with the desired dew point then passes to the chamber 23 through the conduit 41.

Figure 2:
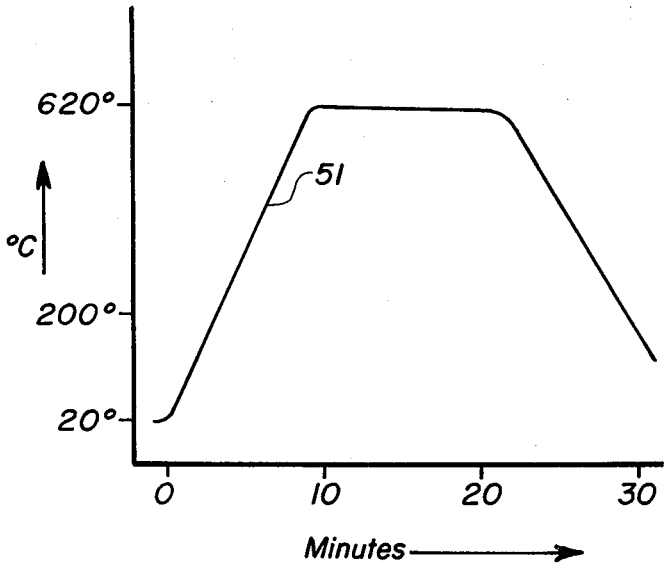
FIG. 2 is a graph showing an idealized time-temperature relationship for steel parts treated according to the novel method in the apparatus shown in FIG. 1.

In a preferred embodiment, the belt speed is adjusted so that each part passes through the chamber 23 in about 30 minutes. The furnace sections are of equal lengths so that each part is present in each section for about 10 minutes. The wet nitrogen with a dew point of 22°±2° C. is introduced into the chamber 23 at about the junction between the reaction section 35 and the cooling section 37 at a rate of about 0.3 to 0.6 cubic meter per minute (about 10 to 20 cubic feet per minute). The temperature profile in the chamber is adjusted to be about the graph 51 shown in FIG. 2, with the reaction section held at about 620°±10° C. With the furnace 21 operating as just described, parts 31 of low carbon (<0.1 weight %) rimmed steel are placed on the belt 25 and are carried through the chamber 23 in about 30 minutes.

It is noteworthy that the only controls necessary for the furnace atmosphere in the novel method are flow rate, dew point and purity. This is to be contrasted with the exothermic blackening method in which controls for the furnace atmosphere include these controls and at least the following in addition: ratio of $CO_2/CO$, % $CO_2$, ratio of $H_2O/H_2$, and % $O_2$. In addition, the exothermic method requires means, not required by the novel method, to prevent the accumulation of flammable and explosive mixtures and to prevent the escape of CO, $H_2$ and obnoxious gases from the furnace.

The novel method produces a deep-black coating on the surface of each part. This degree of blackness is more desirable than the blue-black produced by the steam blackening or the gray-black produced by the dry-nitrogen-blackening method. The coating is highly adherent to the surface. The coating does not flake off when a thin section of the part is bent back and forth, or when the part is thermally cycled between 20° and 600° C. in a protective atmosphere.

In another embodiment, the procedure is the same as for the preferred embodiment described above, except that the parts 31 are of low carbon (<0.01 weight % carbon) aluminum-killed steel, the wet nitrogen has a dew point of about +20°±5° C. and the reaction section 35 is held at about 560°±10° C. for about 10 minutes.

Figure 3:
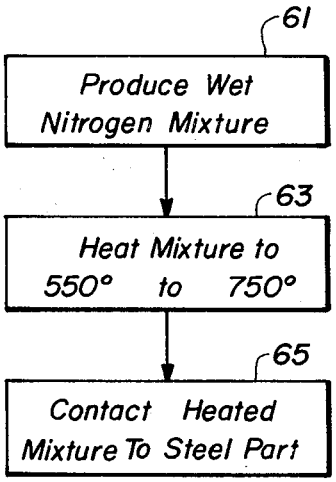
FIG. 3 is a block flow chart illustrating the novel method.

The novel method may be described generally with respect to the flow chart shown in FIG. 3. The first step, shown by the box 61, is to produce the desired wet-nitrogen mixture in which the dew point is between −8° and +32° C. This corresponds to about 0.3 to 4.7 volume percent of water vapor. No other gas; for example, hydrogen, oxygen or carbon compound, is present in amounts that are reactive with the steel of the parts to be treated. Pure nitrogen can be obtained by separation from decomposed nitrogen compounds or from the ambient atmosphere by methods known in the art. The dew point (water vapor content) of the nitrogen can then be adjusted with a bubbler as described above or by any other method known in the art. Since only two chemically-stable gases, which are readily available in relatively pure form and which do not react with one another in the temperature range of interest, are involved, the only required process controls are the dew points and the rate of flow of the nitrogen gas.

The wet nitrogen is now heated up to the desired reaction temperature in the range of about 550° to 750° C., as indicated by the box 63. This may be done in a separate apparatus, but is preferably done in the cooling section of the blackening furnace where it functions as a protective atmosphere and picks up the heat released by the cooling parts and the steel belt. As is known in the art, the highest reaction temperature and the rate of flow of the wet nitrogen gas are chosen with respect to the time that the part is exposed to the reaction temperature, and the desired thickness of the blackening. The shorter the exposure time and the thicker the blackening is to be, the higher the reaction temperature and the faster the rate of flow required. The lower the reaction temperature and/or the shorter the reaction time, the thinner will be the black layer. Black oxide layers formed at temperatures below about 550° C. require long reaction times, appear bluish in color and may not provide adequate infrared emissivity and/or rust protection.

The heated mixture is now contacted with the surface of the part for at least 2 minutes and preferably about 5 to 15 minutes, as indicated by the box 65. The preferred method of contacting is in a furnace chamber as described with respect to FIG. 1, where the part and the gas counter flow through a reaction section and both are heated to about the temperature of the reaction section prior to entry into that section. Also, the time each part is in the reaction section is determined by the speed of the belt. The faster the belt speed, the shorter will be the time that the part is in the reaction section. However, any other method of bringing the heated gaseous mixture into contact with the surface of the part may be used.

The parts may be of steel which has a carbon content below 1.0 weight percent. Where the carbon content is above about 0.1 weight percent of the steel, the novel method could have a decarburizing effect which could reduce the tensile strength of the part and also could lower the magnetic coercivity of the part. Where the carbon content of the steel is below about 0.1 weight percent, the novel method has substantially no effect on tensile strength or magnetic coercivity.

During the period in which the wet-nitrogen gas contacts the parts, oxides of iron, principally $Fe_3O_4$, form as layers on the surfaces of the parts. The layers are preferably about 1 to 6 microns thick. The longer the exposure and/or the higher the temperature, the thicker will be the layers. Layers thicker than 6 microns can be produced by the novel method but may be undesirable if they tend to flake off upon subsequent mechanical or thermal cycling.

The parts are then cooled to below 200° C. in a protective atmosphere. While not necessary, it is preferred that the parts be cooled as uniformly as possible to reduce the amount of stress remaining in them. Cooling is preferably carried out in the wet-nitrogen gas used to produce the black layers or in a chemically neutral atmosphere. A protective atmosphere is one that will not change the characteristics of the black layers in any substantial way.

What is claimed is:

1. A method of blackening surfaces of steel parts comprising (a) producing a gaseous mixture consisting essentially of nitrogen and water vapor, said mixture having a dew point of about −8° to +32° C., (b) heating said gaseous mixture to about 600° to 750° C., and (c) contacting said heated mixture with said steel parts for about 5 to 15 minutes.

2. The method defined in claim 1 wherein said gaseous mixture is essentially free from molecular hydrogen, molecular oxygen and gaseous carbon compounds.

3. The method defined in claim 1 wherein said dew point is about +22±2° C.

4. The method defined in claim 1 wherein said gaseous mixture is heated at about 620°±10° C.

5. The method defined in claim 1 wherein said steel part contains less than 0.1 weight percent carbon.

6. The method defined in claim 1 wherein said steel parts are maintained in said heated gaseous mixture for about 10 minutes.

7. The method defined in claim 1 wherein, after step (c), said steel part is cooled to below 200° C. in a protective atmosphere.

8. A method of blackening surfaces of a steel part comprising (a) producing a gaseous mixture consisting essentially of nitrogen and water vapor, said mixture having a dew point of about −8° to +32° C., (b) heating said gaseous mixture to about 550° to 750° C., and (c) contacting said heated mixture with said surfaces of said steel part for a sufficient time to produce deep-black adherent layers on said surfaces.

9. The method defined in claim 8 wherein said gaseous mixture is essentially free from molecular hydrogen, molecular oxygen and gaseous carbon compounds.

10. The method defined in claim 8 wherein said dew point is about +22±2° C., said gaseous mixture is heated at about 620°±10° C., and said part is of rimmed steel.

11. The method defined in claim 8 wherein said dew point is about +20°±5° C., said gaseous mixture is heated at about 560°±10° C., and said part is of aluminum-killed steel.

12. The method defined in claim 8 wherein said contacting time is at least 2 minutes.

13. The method defined in claim 8 wherein said contacting time is about 2 to 15 minutes.

* * * * *